US007981300B2

(12) United States Patent
Wacome

(10) Patent No.: US 7,981,300 B2
(45) **Date of Patent: *Jul. 19, 2011**

(54) TREATING RUNOFF

(76) Inventor: Todd Wacome, Andover, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/701,845

(22) Filed: Feb. 8, 2010

(65) Prior Publication Data

US 2010/0133201 A1 Jun. 3, 2010

Related U.S. Application Data

(63) Continuation of application No. 11/970,874, filed on Jan. 8, 2008, now Pat. No. 7,658,857.

(51) Int. Cl.
*E03F 5/14* (2006.01)

(52) U.S. Cl. ..... 210/747.3; 210/806; 210/164; 210/170.03; 210/338

(58) Field of Classification Search ..... 210/747, 210/791, 806, 162, 163, 164, 170.03, 337, 210/338, 339

See application file for complete search history.

(56) References Cited

U.S. PATENT DOCUMENTS

| | | | |
|---|---|---|---|
| 1,207,776 | A | 12/1916 | McDonald |
| 3,815,748 | A | 6/1974 | Johannessen |
| 4,261,823 | A | 4/1981 | Gallagher et al. |
| 4,419,232 | A | 12/1983 | Arntyr et al. |
| 5,037,541 | A | 8/1991 | Ruey-Jang et al. |
| 5,284,580 | A | 2/1994 | Shyh |
| 5,779,888 | A | 7/1998 | Bennett |
| 5,980,740 | A | 11/1999 | Harms et al. |
| 6,086,758 | A | 7/2000 | Schilling et al. |
| 6,231,758 | B1 | 5/2001 | Morris et al. |
| 6,270,663 | B1 | 8/2001 | Happel |
| 6,294,095 | B1 | 9/2001 | Lewis |
| 6,368,499 | B1 | 4/2002 | Sharpless |
| 6,517,709 | B1 | 2/2003 | Cardwell et al. |
| 6,537,446 | B1 | 3/2003 | Sanguinetti |
| 7,128,832 | B2 | 10/2006 | Wade |
| 7,186,333 | B2 | 3/2007 | Kluge |
| 2003/0034286 | A1 | 2/2003 | Butler |
| 2004/0094461 | A1 | 5/2004 | Sharpless |
| 2005/0183997 | A1 | 8/2005 | Happel et al. |
| 2005/0279709 | A1 | 12/2005 | Peters et al. |
| 2006/0266681 | A1 | 11/2006 | Lockerman et al. |

*Primary Examiner* — Christopher Upton
(74) *Attorney, Agent, or Firm* — Fish & Richardson P.C.

(57) ABSTRACT

Systems and methods for treating water passing through a catch basin may include first and second filters. In some embodiments, one or both of the filters can have a plurality of regions with different nominal flow rates.

19 Claims, 7 Drawing Sheets

TREATING RUNOFF

CROSS REFERENCE TO RELATED APPLICATION

This application is a continuation of (and claims the benefit of priority under 35 U.S.C. 120) U.S. patent application Ser. No. 11/970,874, filed Jan. 8, 2008 now U.S. Pat. No. 7,658,857. The disclosure of the prior application is incorporated herein by reference.

TECHNICAL FIELD

This application relates to treating runoff entering storm drain systems.

BACKGROUND

Storm drain systems are designed to retain and collect runoff to be channeled to locations where it can be safely dispersed. Typically, and in particular during heavy flows, the runoff can carry particulate matter and debris. Runoff entering a storm drain system is typically collected first in a catch basin designed to remove particulate matter and debris from the runoff. Over time, silt and debris can clog the catch basin resulting, for example, in blocked outlet pipes, with water overflow and/or undesirable discharge of particulate matter out of the catch basin. Periodically, catch basins require expensive and time-consuming removal of material collected in the catch basin (e.g., using a vacuum truck) to reduce the risk of local flooding and the undesirable discharge of particulate matter out of the catch basin.

SUMMARY

Systems and methods of treating runoff (e.g., liquids such as rainwater and solids floating on, suspended in, or otherwise pushed/carried by the liquid components of runoff) using graduated filters can provide a combination of both good filtration and additional flow capacity. Filters can remove particulate matter (e.g., silt, sand, and/or other particles) and/or debris (e.g., rocks, sticks, leaves, trash, litter, or other foreign objects) from runoff. Filters (e.g., bag filters suspended within a storm drain catch basin or sheet-form filters mounted within a storm drain catch basin) can have multiple regions with each region having a nominal flow rate (e.g., in gallons per minute per square foot as measured using ASTM D-4491) that is higher than an adjacent relatively lower region. The lower regions with a relatively lower nominal flow rate can provide a high degree of filtration for the runoff from small storm events. For larger storm events, as the rate of runoff entering a storm drain catch basin exceeds the rate at which water is filtered through the lower regions with a lower nominal flow rate, the level of water on the inlet side of the filters increases bringing the higher regions with a relatively higher nominal flow rate into operation. These higher regions with a higher nominal flow rate provide less filtration but greater flow capacity than the lower regions with a lower nominal flow rate.

For example, flexible bag filters having multiple, graduated regions, e.g. each region having a nominal flow rate that is relatively higher than an adjacent lower region, can be suspended (e.g., removably mounted) within a storm drain catch basin. The regions with lower nominal flow rate provide a high degree of filtration for the runoff from small storm events and also provide some filtration when treating higher volumes of runoff from larger storm events. Such bag filters can be positioned with the bottom of the bag filter located at approximately the elevation of the outlet pipe through which water is discharged from the catch basin. Made of flexible material and configured to be suspended within a catch basin, such bag filters are easy to install and easy to remove for cleaning.

Flexible bag filters can also be used with other filters having graduated filtration/flow characteristics. For example, a flexible bag filter can be suspended within a catch basin with sheet-form filter disposed between the bag filter and the outlet of the catch basin such that some or all of the water discharged from catch basin has passed through two filters. In one aspect, systems configured to treat water passing through a catch basin include: a first filter including an open end, a sidewall portion, and a closed end generally opposite the open end, the open end of the first filter removably mounted below an inlet of the catch basin; and a second filter extending from a first end portion having a first perimeter to a second end portion having a second perimeter relatively larger than the first perimeter, the first end portion of the second filter removably mounted to define an opening below the inlet of the catch basin, and the second end portion of the second filter removably secured to an inner surface of the catch basin, spaced apart from the inlet of the catch basin, such that the second filter defines a surface separating a inner portion of the catch basin from an outer portion of the catch basin.

Embodiments can include one or more of the following additional features:

In some embodiments, the sidewall portion of the first filter defines a first region of the first filter having a first nominal flow rate and a second region of the first filter having a second nominal flow rate that is relatively greater than the first nominal flow rate, the second region of the first filter disposed between the first region of the first filter and the open end of the first filter. In some cases, the sidewall portion of the first filter further defines a third region of the first filter having a third nominal flow rate greater than the first nominal flow rate and less than the second nominal flow rate, the third region of the first filter located between the first and second regions of the first filter. In some cases, the sidewall portion of the first filter further defines a plurality of intermediate regions of the first filter located between the first region of the first filter and the second region of the first filter, each of the intermediate regions of the first filter having a nominal flow rate greater than the nominal flow rate of an adjacent region of the first filter in the direction of the first region of the first filter and each of the intermediate regions of the first filter having a nominal flow rate less than the nominal flow rate of an adjacent region of the first filter in the direction of the second region of the first filter.

In some embodiments, the sidewall portion of the first filter includes a support structure including a first fabric having a first apparent opening size, the support structure lined with a second fabric having a second apparent opening size that is relatively smaller than the first apparent opening size. In some cases, the second fabric includes non-woven material.

In some embodiments, the system further includes a frame removably mounted to a region of the inlet of the catch basin and the open end of the first filter is attached to the frame. In some cases, the open end of the first filter is attached to the frame by a plurality of chains.

In some embodiments, wherein the second filter defines a first region of the second filter having a first nominal flow rate and a second region of the second filter having a second nominal flow rate relatively greater than the first nominal flow rate, the second region of the second filter disposed between the first region of the second filter and the first end portion. In some cases, the second filter further defines a third region of the second filter having a third nominal flow rate, the third region of the second filter located between the first and second region of the second filters, the third nominal flow rate being relatively greater than the first nominal flow rate and relatively less than the second nominal flow rate.

In some embodiments, the first filter has an outer perimeter substantially identical in shape and smaller in size to an inner perimeter of the inlet to the catch basin.

In some embodiments, the second filter includes a pleated material.

In some embodiments, the system also includes a support member attached to the second end portion of the second filter and removably secured to the inner surface of the catch basin.

In some embodiments, the system also includes a spacing member removably secured to an inner surface of the catch basin, the spacing member disposed between the second filter and the outlet of the catch basin.

In another aspect, methods of treating runoff include: suspending a first filter from an inlet of a catch basin in a position such that water and solid material passing through the inlet of the catch basin enters the first filter; installing a second filter in a catch basin in a position such that the second filter defines a continuous surface separating the catch basin into an lower inner portion and an upper outer portion, wherein the first filter is suspended substantially within the lower inner portion of the catch basin and the catch basin outlet is in the upper outer portion of the catch basin; retaining some solid material within the first filter as water passes through the first filter into the inner portion of the catch basin; and retaining some solid material within the inner portion of the catch basin as water passes through the second filter into the upper part outer portion of the catch basin and flows out the catch basin outlet.

Embodiments can include one or more of the following additional features:

In some embodiments, retaining some solid material within the first filter includes providing a first degree of filtration to water that passes through a first region of the first filter having a first nominal flow rate; and providing a relatively lower (i.e. relatively more coarse) degree of filtration to water that passes through a second region of the first filter having a second nominal flow rate that is greater than the first nominal flow rate.

In some embodiments, the methods also include, e.g. after a time: removing the first filter from the catch basin; emptying the solid material retained in the first filter; and re-installing the first filter in the inlet of the catch basin.

In some embodiments, the methods also include, e.g. after a time: removing solid material debris from the catch basin while the first filter is removed from the catch basin and the second filter is installed in the catch basin.

In another aspect, systems configured to treat water passing through a catch basin include: a filter defining an open end, a sidewall portion, and a closed end opposite the open end, the open end of the filter removably mounted below an inlet of the catch basin. The sidewall portion of the filter defines a first region of the filter having a first nominal flow rate and a second region of the filter having a second nominal flow rate that is greater than the first nominal flow rate, the second region of the filter disposed between the first region of the filter and the open end of the filter. Embodiments can include one or more of the following features.

In some embodiments, the sidewall portion of the filter further defines a third region of the filter having a third nominal flow rate greater than the first nominal flow rate and less than the second nominal flow rate, the third region of the filter located between the first and second regions of the filter.

In some embodiments, the sidewall portion of the filter further defines a plurality of intermediate regions of the filter located between the first region of the filter and the second region of the filter, each of the intermediate regions of the filter having a nominal flow rate relatively greater than the nominal flow rate of an adjacent region of the filter in the direction of the first region of the filter and each of the intermediate regions of the filter having a nominal flow rate relatively less than the nominal flow rate of an adjacent region of the filter in the direction of the second region of the filter.

In some embodiments, the sidewall portion of the filter includes a support structure including a first fabric having a first apparent opening size, the support structure lined with a second fabric having a second apparent opening size that is relatively smaller than the first apparent opening size.

In some embodiments, the system further includes a frame removably mounted to a region of the inlet of the catch basin, wherein the open end of the filter is attached to the frame. In some cases, the open end of the filter is attached to the frame by a plurality of chains.

In some embodiments, the filter has an outer perimeter corresponding, e.g. substantially identical, in shape and size to an inner perimeter of the inlet to the catch basin.

In some embodiments, the distance from the open end of the filter to the closed end of the filter is greater than 90 percent of the difference in elevation between the inlet of the catch basin and an invert of an outlet of the catch basin.

In another aspect, methods of treating runoff include: suspending a filter from an inlet of a catch basin in a position such that water and solid material passing through the inlet of the catch basin enter the filter; and retaining some solid material within the filter as water passes through the filter into the inner portion of the catch basin. Retaining some solid material within the filter includes providing a first degree of filtration to water that passes through a first region of the filter having a first nominal flow rate; and providing a lower (e.g. coarser) degree of filtration to water that passes through a second region of the filter having a second nominal flow rate that is relatively greater than the first nominal flow rate. Embodiments can include one or more of the following features.

In some embodiments, the methods also include, e.g. after a time, removing the filter from the catch basin; emptying the solid material retained in the filter; and re-installing the filter in the inlet of the catch basin.

In some embodiments, suspending the filter includes lowering the filter through the inlet of the catch basin until a frame attached to the filter engages sides of the inlet of the catch basin. In some cases, the methods also include removing the filter from the catch basin by lifting the frame vertically.

In another aspect, systems configured to treat water passing through a catch basin include: a filter extending from a first end portion having a first perimeter defining an opening to a second end portion having a second perimeter relatively larger than the first perimeter, the first end portion attached to an inlet of a catch basin and the second end portion removably secured to an inner surface of the catch basin, the inner surface of the catch basin spaced from the inlet of the catch basin, such that the filter defines a continuous surface separating a inner portion of the catch basin from an upper, outer portion of the catch basin. The filter includes a first filter region having a first nominal flow rate and a second filter region having a second nominal flow rate relatively greater than the first nominal flow rate, the second filter region disposed between the first filter region and the first end portion.

Embodiments can include one or more of the following additional features.

In some embodiments, the filter further defines a third filter region having a third nominal flow rate, the third filter region located between the first and second filter regions, the third nominal flow rate being relatively greater than the first nominal flow rate and relatively less than the second nominal flow rate.

In some embodiments, the filter includes a support structure and a separate porous liner material disposed inside the support structure.

In some embodiments, the filter includes a pleated material.

In some embodiments, the filter also includes a support member attached to the second end portion and removably secured to the inner surface of the catch basin.

In some embodiments, the system also includes a spacing member removably secured to an inner surface of the catch basin, the spacing member disposed between an outlet of the catch basin and the filter.

Embodiments may include one or more of the following advantages.

Filters (e.g., bag filters and/or tent-shaped filters ("tent filters")) can reduce the undesirable discharge of silt and debris from the catch basin and/or reduce local flooding. In operation, runoff can fall into a bag filter and then will tend to seep through and run down outer surfaces of the filter rather than falling directly to the bottom of the catch basin. In some instances, the bag filter can dissipate the kinetic energy of water falling into the catch basin and reduce the re-suspension of silt and debris which have settled to the bottom of the catch basin. Similarly, the tent filter can reduce the re-suspension of silt and debris which have settled to the bottom of the catch basin by isolating such material from water flowing into a catch basin from upstream portions of a storm water drainage system.

Moreover, silt and debris collects, to some extent, in the bag filter. Associated reductions in the amount of material that accumulates at the bottom of catch basins can reduce the costs associated with the removal of such material. Bag filters can be configured for removal from catch basins for cleaning by equipment frequently available on construction sites (e.g., backhoes) rather than requiring specialized equipment such as vacuum trucks.

Filter systems configured as discussed above can also use the excess catch basin capacity (i.e., the volume above the invert of the outlet) to store and gradually release runoff from the catch basin. The filter systems can change the direction and increase the distance that runoff travels within the catch basin. This can increase the retention time of runoff within the catch basin and, thus, provide additional time for fine particles to settle out of the runoff before it is discharged from the catch basin.

Tent filters can provide secondary filtration and/or treatment when used in conjunction with the bag filter. Tent filters with graduated levels of filtration/flow capacity can also be used independently as the primary source of treatment for runoff.

Tent filters configured and installed to provide a truncated conical surface between outer and inner portions of a catch basin can be easy to clean. Flow of runoff through such tent filters can cause particulate matter to accumulate on what is, in effect, the underside of the tent filter. Thus, in the absence of internal water pressure, gravity will tend to pull accumulated particulate matter off the tent filter into the bottom of the catch basin to settle. Spraying the tent filter from the outer portion of the catch basin towards the inner portion of the catch basin provides backwashing that is aided by the effects of gravity.

In some embodiments, the filtration systems or methods can be installed or applied in a standard drainage catch basin. The filtration system or method can serve to reduce large surges of water by collecting the water quickly and releasing it over a period of time.

In some embodiments, the bag filter is lightweight when empty. The filtration system or method can be installed or carried out by one person.

In certain embodiments, the filtration system or method can be custom-configured for specific storm drain catch basins and/or catch basin drainage areas. The filtration system or method can limit the re-suspension of sediments (e.g., particulate matter and/or debris) in the catch basin.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1A:
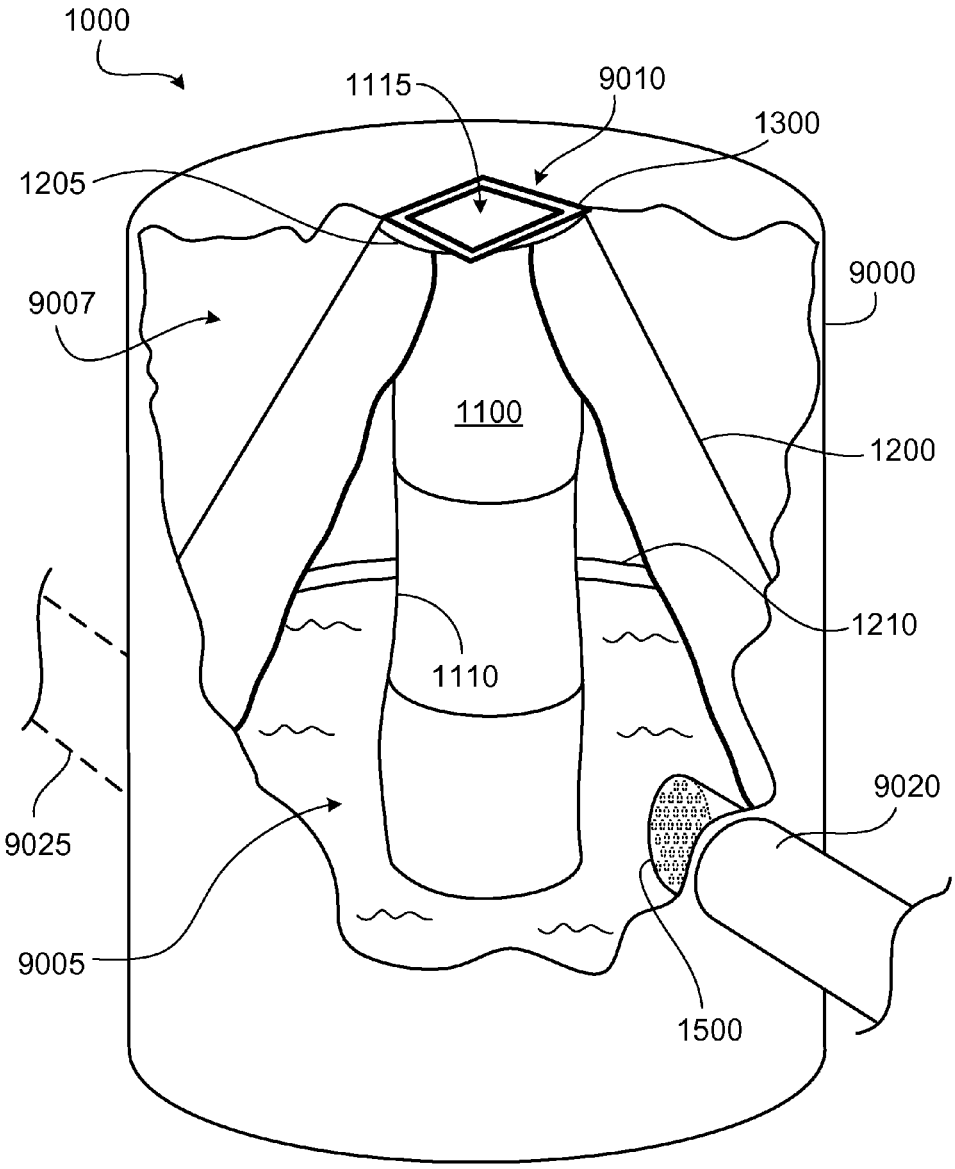
FIGS. 1A and 1B are, respectively, a cut-away view and a cross-sectional view of a two-filter system installed in a catch basin.
Figure 1B:
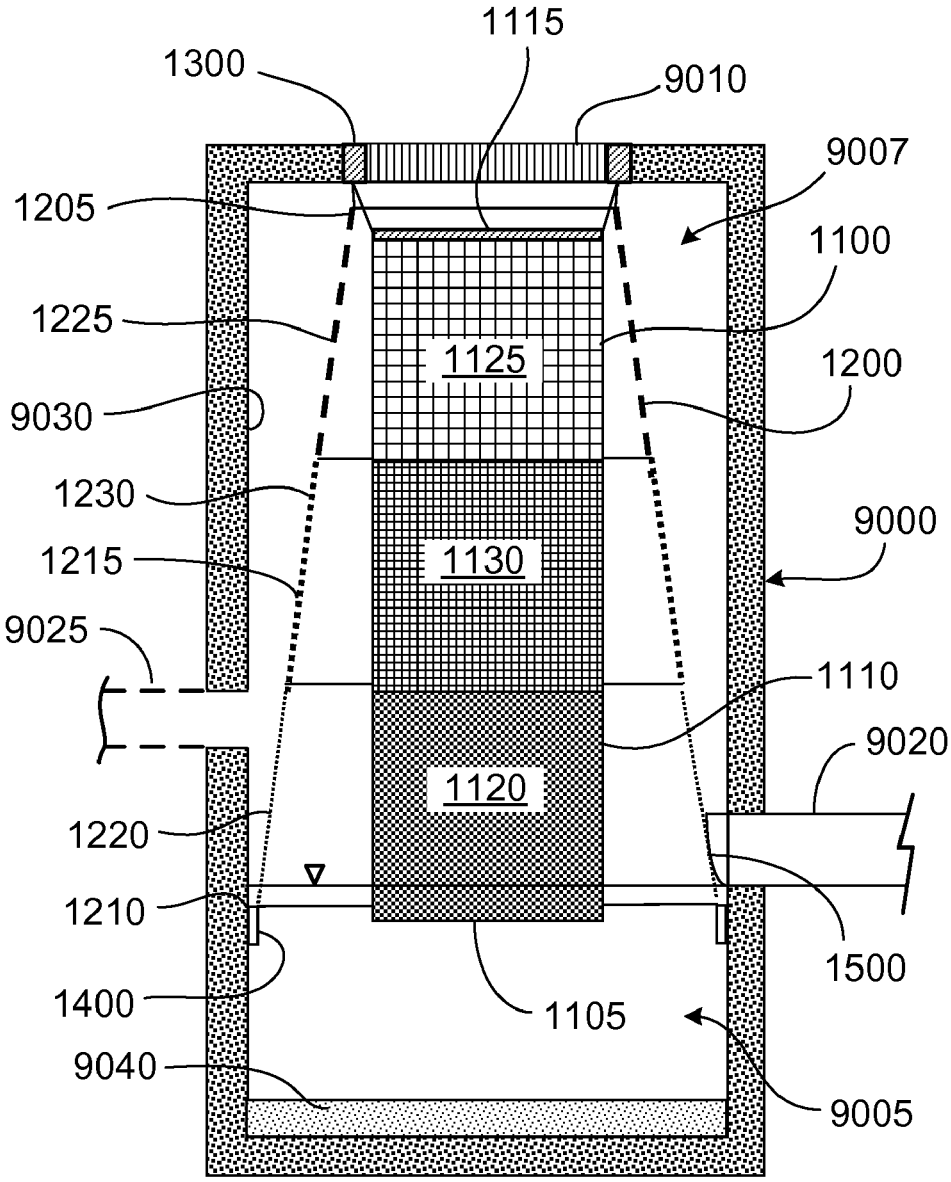

Referring to FIGS. 1A and 1B, a system 1000 configured to remove particulate matter and debris from runoff entering catch basins is installed in catch basin 9000. System 1000 includes a first filter 1100 and a second filter 1200. Both filters 1100, 1200 are configured with multiple regions with each region having a relatively greater nominal flow rate than an adjacent lower region. The lower regions with a lower nominal flow rate provide a relatively higher degree of filtration for treating the runoff from small storm events. For larger storm events, as the rate of runoff entering catch basin 9000 exceeds the rate at which water flows through the lower regions with a lower nominal flow rate, the level of runoff on the inlet side of the filters increases bringing the higher regions with a higher nominal flow rate into operation. These higher regions with a higher nominal flow rate provide less filtration but provide greater flow capacity than the lower regions with a lower nominal flow rate.

First filter 1100 is a bag filter (e.g., a filter with an open end, sides, and a closed bottom) suspended within catch basin 9000. First filter 1100 can be formed of a flexible material (e.g., a fabric or fabrics) to facilitate installation before use and removal for cleaning. Runoff entering catch basin inlet 9010 falls into bag filter 1100, which absorbs the kinetic energy of the falling material. As runoff passes through the porous walls of bag filter 1100, some of the particulate matter and debris in the runoff is retained within bag filter 1100. Although water, particulate matter, and debris can overflow during periods of high runoff flows, bag filter 1100 generally serves to detain the water and release it into the catch basin, and hence the storm drain system, over time. This detention and filtering limits the undesirable discharge of particulate matter and debris into the storm drain system and eventually into potentially environmentally-sensitive dispersal locations. This detention also reduces the likelihood of large surges of water from being released into the storm drain system and re-suspending previously settled material (e.g., silt).

Water that passes through or overflows bag filter 1100 tends to flows down the side(s) of bag filter 1100. Bag filter 1100 can be sized to extend to the standing water level in catch basin 9000 so that water, particulate matter, and debris that move from bag filter 1100 into catch basin 9000 are less likely to freefall and usually gain only small amounts of kinetic energy. Thus, water that leaves the bag filter is unlikely to disturb the water, particulate matter, and debris already present in catch basin 9000. This limits the re-suspension of sediments 9040 (e.g., particulate matter and debris) from the floor of catch basin 9000 and also allows newly-introduced particulate matter and debris to settle to the floor of catch basin 9000.

Rising water in catch basin 9000 passes through second filter 1200 and exits through catch basin outlet 9020, while some additional particulate matter and debris is retained within catch basin 9000. Second filter 1200 can expand toward the walls of catch basin 9000 during periods of excessive runoff so that more of the internal volume of catch basin 9000 is utilized for storage and detention.

Bag filter 1100 is configured for removal from catch basin 9000 by equipment such as backhoes or vacuum trucks for cleaning. Between periods of runoff, bag filter 1100 can be removed to allow for disposal of the particulate matter and debris retained within bag filter 1100. Eventually, enough particulate matter and debris may collect in catch basin 9000 (by passing through the porous walls of bag filter 1100 or overflowing bag filter 1100 altogether) to necessitate the removal of such particulate matter and debris using a vacuum truck or other means. Because most of the particulate matter and debris that falls through catch basin inlet 9010 will be collected in bag filter 1100, the cleaning frequency of catch basin 9000 can be reduced. Thus, bag filter 1100 and second filter 1200 can prevent particulate matter and debris from clogging storm drain systems and damaging environmentally-sensitive dispersal locations while also reducing the costs of maintaining the storm drain systems and increasing their effectiveness.

Figure 1C:
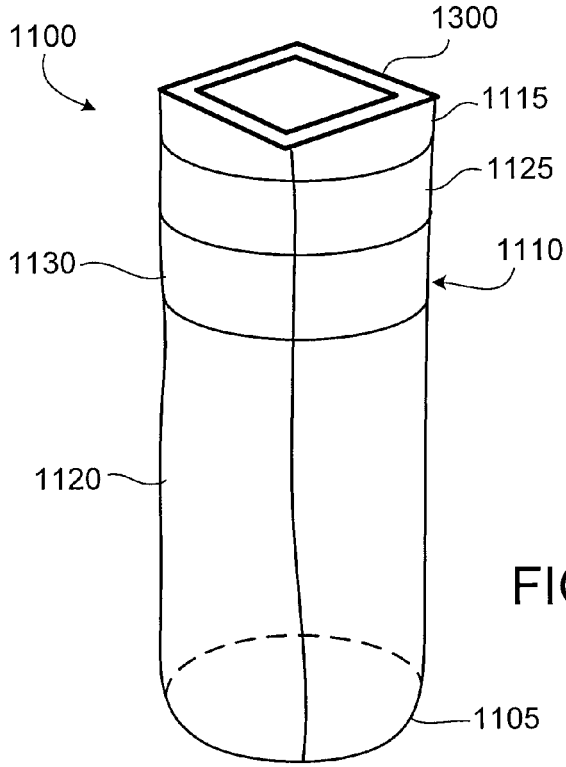
FIGS. 1C and 1D are perspective views of, respectively, the inner filter and the outer filter of the two-filter system shown in FIGS. 1A and 1B.

Referring also to FIGS. 1B and 1C, a bag filter 1100 includes a closed end 1105, a sidewall portion 1110, and an open end 1115. Open end 1115 is opposite closed end 1105, and may be removably mounted in a region of a catch basin inlet 9010 or to a frame 1300. Frame 1300 may be removably mounted to catch basin inlet 9010.

Sidewall portion 1110 of bag filter 1100 may include a first bag region 1120, having a first nominal flow rate; a second bag region 1125, located between first bag region 1120 and open end 1115, and having a second nominal flow rate relatively greater than first nominal flow rate; and a third bag region 1130, located between first bag region 1120 and second bag region 1125, and having a third nominal flow rate relatively greater than first nominal flow rate and relatively less than second nominal flow rate. Generally, first bag region 1120 also includes closed end 1105 of bag filter 1100 in addition to the lower part of sidewall portion 1110. However, in some embodiments, closed end 1105 is made of or lined with an impermeable material and does not transmit water through the bag filter.

Bag filter 1100 is configured to overflow when incoming runoff flows are greater than the flow capacity of bag regions 1120, 1125, 1130 (e.g., the amount of water that can flow through the bag regions for given water levels in the system). In this embodiment, bag filter 1100 is suspended in catch basin 9000 and such overflows pass through the space between the top of sidewall portion 1110 of bag filter 1100 and catch basin inlet 9010. In some embodiments, sidewall portion 1110 includes an overflow region (not shown) that does not provide significant filtering and allows the generally free passage of such overflows. Bag regions 1120, 1125, and 1130 may be sized equally or differently; any one bag region may be larger or smaller than other bag regions, i.e., may cover more or less surface area of sidewall portion 1110, than any other bag region. In any implementation of bag filter 1100, the sizes of bag regions 1120, 1125, 1130, and of any other bag region or regions may be optimized for a given geographical region, locality, or climate, or for average or expected flow through a specific catch basin, to ensure the proper balance between filtration and water flow.

Figure 1D:
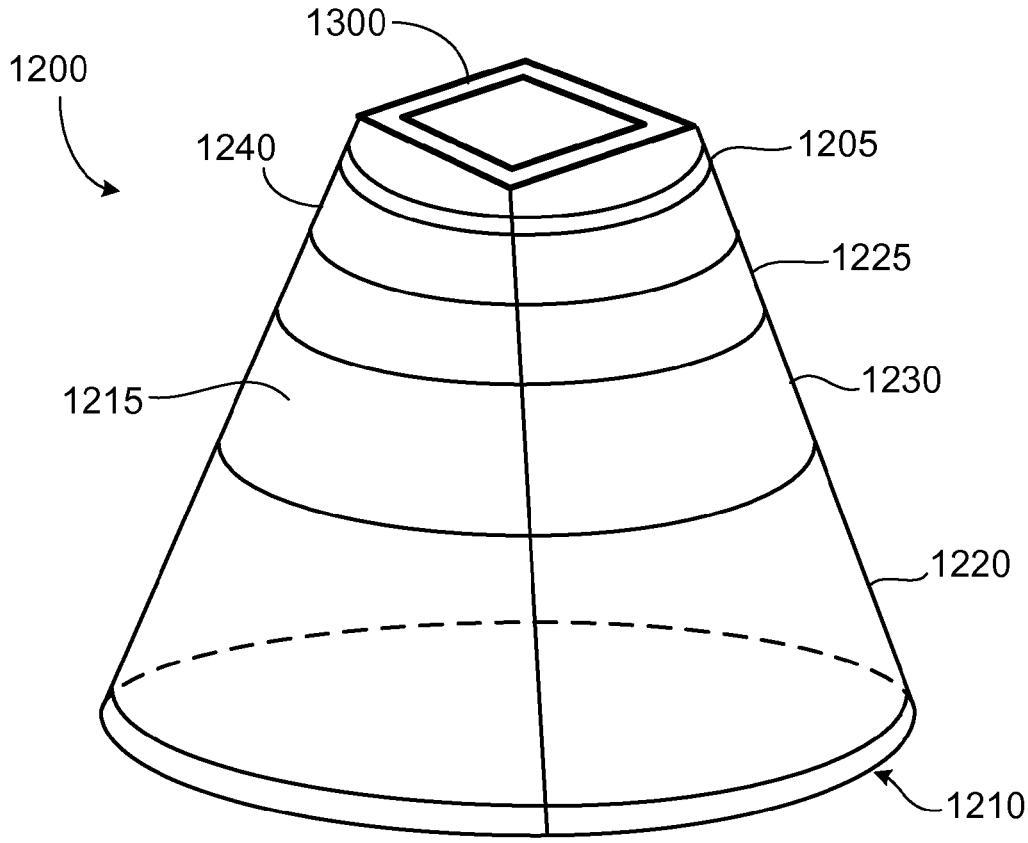

Referring now also to FIGS. 1B and 1D, second filter 1200 is a tent filter that includes a first end portion 1205 and a second end portion 1210. The perimeter of second end portion 1210 is greater than the perimeter of first end portion 1205. First end portion 1205 may be attached to catch basin inlet 9010, or it may be attached to frame 1300. Second end portion 1210 may be attached (e.g., bolted) directly to an inner surface 9030 of catch basin 9000 at a location spaced apart from catch basin inlet 9010, or it may be attached to a support member 1400 that is removably securable to inner surface 9030. In certain implementations, tent filter 1200 defines a continuous surface 1215 separating a inner portion 9005 of the cavity of catch basin 9000 from an outer portion 9007 of the cavity of catch basin 9000, with catch basin outlet 9020 located in the outer portion 9007 of the cavity of catch basin 9000. For example, tent filter 1200 can provide a truncated conical surface between outer and inner portions 9005, 9007 of the cavity of catch basin 9000 such that the inner portion 9005 of the cavity of the catch basin is below as well as within the outer portion 9007 of the cavity of catch basin 9000. In some cases, catch basins 9000 receive water from upstream portions of drainage system through inlet pipes 9025. In these cases, tent filter 1200 can be disposed such that inlet pipe 9025 discharges into the outer portion 9007 of the cavity of catch basin 9000.

In some embodiments, tent filter 1200 may have a system of regions with graduated nominal flow rates similar to the systems described above with respect to bag filter 1100. For example, as shown in FIG. 1C, tent filter 1200 may have a first filter region 1220 adjacent to second end portion 1210, a second filter region 1225 adjacent to first end portion 1205 and between first end portion 1205 and first filter region 1220, and a third filter region 1230 located between first filter region 1220 and second filter region 1225. Each filter region has a corresponding nominal flow rate. Each nominal flow rate is relatively greater than the nominal flow rate of the adjacent filter region in the direction of second end portion 1210 and is relatively less than the nominal flow rate of the adjacent filter region in the direction of first end portion 1205.

In some embodiments, tent filter 1200 may have only first filter region 1220 having first nominal flow rate, and second filter region 1225 having second nominal flow rate. In some embodiments, tent filter 1200 may have more than three filter regions. In certain embodiments, tent filter 1200 may have a filter overflow 1240, located adjacent first end portion 1205 or located between first end portion 1205 and second filter region 1225.

The sizes of the various filter regions may be equal or different. For example, the sizes of any or all of the filter regions may be optimized for a given geographical region, locality, or climate, or for the needs of a particular catch basin, to ensure a proper balance between filtration and water flow.

A optional spacing member 1500, such as that shown in FIGS. 1A and 1B, may also be used in conjunction with tent filter 1200. Spacing member 1500 may be removably securable to an inner surface of catch basin outlet 9020 to prevent tent filter 1200 from directly contacting catch basin outlet 9020 and, in some embodiments, may be attached to second end portion 1210 of tent filter 1200. Spacing member 1500 is a perforated, quarter-spherical metal member that extends into the catch basin 9000 from the sides and bottom of catch basin outlet 9020. Spacing member 1500 has an open top to allow water to enter the catch basin outlet 9020 even if the perforations in the surface of spacing member 1500 become clogged. In some embodiments, spacing member 1500 can have other shapes (e.g., an open-top rectangle or a hemisphere) and/or can be formed of other materials (e.g., plastics). A spacing member 1500 can also be provided adjacent inlet pipes 9025 when inlet pipes 9025 are present. However, the flow of water from upstream portions of a drainage system will tend to push tent filter 1200 away from the opening of the inlet pipes.

In some embodiments, bag filter 1100 is manufactured by forming a support structure from a strong, coarse mesh. Inner surfaces of support structure are then lined with materials having varying flow rates to form bag regions 1120, 1125, 1130. The liner may include multiple pieces of fabric of varying nominal flow rate sewn together to correspond with the various bag regions, or it may be a single piece of fabric manufactured to have a graduated nominal flow rate. In other embodiments, bag filter 1100 can be manufactured by directly attaching (e.g., by sewing) filter materials with desired strength and flow to each other to form a single piece of material with graduated nominal flow rate along the sidewall portion 1110 that increases with distance from closed end 1105. Formed of flexible material such as fabrics, bag filter 1100 can be easily compressed for passage through catch basin inlets during installation.

Bag filter 1100 is configured with a cross-section substantially identical in shape and size to an inner perimeter of catch basin inlet 9010. Constructed of flexible material, bag filter 1100 generally can be pulled out of catch basin 9000 through catch basin inlet 9010 for cleaning even in the event that bag filter 1100 expands somewhat in response to the accumulation of particulate matter and debris. Bag filter 1100 can be sized such that the length of bag filter 1100 from closed end 1105 to inlet 1115 substantially corresponds to the distance between catch basin inlet 9010 and the invert (e.g., lowest point) of catch basin outlet 9020 which tends to be the standing water level within catch basin 9000. Thus, when bag filter 1100 is suspended from catch basin inlet 9010 or frame 1300, closed end 1105 reaches the standing water level inside catch basin 9000. In some implementations, the length of bag filter 1100 from closed end 1105 to inlet 1115 may be greater than the distance from catch basin inlet 9010 to the bottom of catch basin outlet 9020, i.e. to the standing water level of catch basin 9000, such that, in use, closed end 1105 of bag filter 1100 extends beneath the standing water level of catch basin 9000.

The material used in or on any part of bag filter 1100 may be woven or non-woven. In some cases, woven material may be less likely to cake up or clog with silt and small particulate matter than non-woven material. The support structure and/or the liner/filter material can be chosen from materials (e.g., polypropylene fabrics) with sufficient strength that a bag filter 1100 suspended by its top is unlikely to break as particulate matter and debris accumulates within bag filter 1100. For example, the bag filter can be configured having a breaking load of at least 1000 pounds (e.g., breaking load can be defined as the maximum load (or force) applied to a specimen in a tensile test carried to rupture). Individual materials may be high-strength. In some embodiments, individual materials can have minimum tensile strengths of between about 80-380 lbs. (e.g., between, 100-260 lbs., or 120-180 lbs). Tensile strength can be measured using ASTM D-4632. In some embodiments, the material may be UV-resistant. The hydraulic characteristics of the liner/filter material can be defined by apparent opening size (e.g., United States standard sieve sizes) or flow rates (e.g., as measured by ASTM D-4491). Liner/filter material can have apparent opening sizes ranging of 25-150 (e.g., 40-120 or 80-100) United States standard sieve size and/or flow rates of 1-200 (e.g., 1-150, 1-100, or 1-20) gallons per minute per square foot. In some cases, material with a nominal flow rate in the range of about 2 to about 6 gallons per minute per square foot, e.g. about 4 gallons per minute per square foot can be used for a first filter material, other material with a nominal flow rate in the range of about 16 to about 20 gallons per minute per square foot, e.g. about 18 gallons per minute per square foot can be used for a second filter material, and still other material with a nominal flow rate in the range of about 6 to about 16 gallons per minute per square foot, e.g. about 12 gallons per minute per square foot, can be used for the third filter material. The materials in or on bag filter 1100 can also be selected to provide additional treatment. For example, the liner can include oil absorbent materials to remove hydrocarbons from runoff being treated by system 1000.

In one exemplary embodiment, the support structure was formed from a trampoline bed. The seams of bag filter 1100 and the top edge of sidewall portion 1110, i.e. the edge of sidewall portion 1110 that defines open end 1115, were sewn with at least 10 rows of heavy-duty thread to provide structural stability. Galvanized rings or other fasteners were sewn into the top edge of sidewall portion 1110 to facilitate the mounting of bag filter 1100 to a frame 1300 or to a region of catch basin inlet 9010. Geotextiles were sewn to the support structure to form three bag regions. A silt fence material was sewn to the support structure to form the bottom bag region. Two layers of ⅛ inch thick felt filter material were sewn to the support structure to form the intermediate bag region. A single layer of ⅛ inch thick felt filter material was sewn to the support structure to form the top bag region. A portion of the support structure was left unaltered to provide an overflow region.

Tent filter 1200 may be manufactured by forming a support structure in the shape of a truncated cone or pyramid including a first end portion 1205 having a first perimeter, a second end portion 1210 having a second perimeter greater than the first perimeter. The first end portion 1205 and the second end portion can have different shapes (e.g., one could be square and the other could be round). Filter 1200 defines a continuous surface 1215 between first end portion 1205 and second end portion 1210. A liner may be attached to the support structure on the inside of continuous surface 1215. The liner may be a single piece of fabric having a graduated nominal flow rate, or it may include various pieces of fabric of various porosities sewn together and/or onto the support structure, such that filter regions 1220, 1225, and any other filter region or regions have desired nominal flow rates, respectively. In some implementations, a tent filter 1200 may include a single, continuous piece of fabric or material, and having a graduated nominal flow rate, such that the highest nominal flow rate occurs nearest second end portion 1210 and the lowest nominal flow rate occurs nearest first end portion 1205.

Optionally, tent filter 1200 may be formed from a pleated material (e.g., a material having a series of substantially parallel folds). In embodiments including this feature, the tent filter 1200 has a natural state in which the pleats or folds are contracted, and an expanded state (discussed in detail below with reference to FIG. 2C) in which the pleats flatten out to some extent as tent filter 1200 is circumferentially stretched (especially at the top), i.e. by rising water, particulate matter, and debris within catch basin 9000. In order to maintain filter capacity, the tent filter 1200 can be sized and configured such that tent filter does not touch the walls of the catch basin even when stretched. In such an expanded state, tent filter 1200 can utilize more of the internal volume of catch basin 9000 for storage before overflowing. In some cases, tent filter 1200 is made of material with sufficient stiffness that the pleats do not completely unfold even when tent filter is completely full of water, Thus, the pleated material can also provide additional filter area for a given circumference of tent filter 1200. Tent filter 1200 may also be formed of fabric or material that is inherently stretchable to provide a similar effect.

Frame 1300 may be manufactured by welding sections of angle iron in the shape of a catch basin inlet 9010, such that the angle irons are arranged, and frame 1300 is sized, to rest on a perimeter of catch basin inlet 9010. Frame 1300 can be thin enough to allow the original catch basin inlet grate to rest on top of frame 1300 without being significantly raised. Hooks may be attached to frame 1300 and arranged to engage one or both of the top edge of sidewall portion 1110 of bag filter 1100 and first end portion 1205 of tent filter 1200. Alternatively, frame 1300 may be manufactured of any material strong enough to support one or both of tent filter 1200 and bag filter 1100, i.e. when bag filter 1100 is full of particulate matter and debris and water. Frame 1300 may be manufactured in any shape that allows or facilitates the mounting of frame 1300 in a region of catch basin inlet 9010.

In some embodiments, frame 1300 comprises two nested members. A first member is sized and configured to fit within and engage the rim of catch basin inlet 9010 and a second member is sized and configured to fit within and engage the first member. The first member is attached (e.g., by ropes or chains) to tent filter 1200 and the second member is attached (e.g., by ropes, cables, straps with carabineer-type fasteners, or chains) to bag filter 1100. Thus, bag filter 1100 can be removed by lifting on the second member of frame 1300 while the first member of frame 1300 and the attached tent filter 1200 remain in place.

Support member 1400 may be a strip of plastic, metal, or other material configurable into a shape identical to the perimeter of catch basin 9000. Support member 1400 may also include a mechanism that allows support member 1400 to be expanded and contracted. For example, support member 1400 may be a ring formed from a metal strip, with the two ends of the metal strip joined by a mechanism that adjusts the amount by which the two ends overlap, much like the mechanism on a hose clamp, such that the strip can expand to create a tight seal at a fixed elevation. Alternatively, support member 1400 may be a plastic strip formed into a square, i.e. to fit into a square catch basin, and the plastic strip may be temporarily deformable, such that it can be compressed to fit through catch basin inlet 9010 and returns to its original shape once the compressive force is released.

FIG. 1B and FIGS. 2A-2D illustrate representative water levels and flow patterns in system 1000 at different points during a runoff event (e.g., a rain shower or activation of nearby lawn sprinklers). For example, system 1000 can be in an inactive state as illustrated by FIG. 1B. The water level (as indicated by the inverted triangle) in catch basin 9000, both inside and outside bag filter 1100, matches the invert of catch basin outlet pipe 9020. In this condition, no flow is occurring.

As a runoff event begins, water, particulate matter, and debris begin passing through catch basin inlet 9010 and are initially collected in bag filter 1100. Lower bag region 1120 is made of material with a small apparent opening size. Lower bag region 1120 provides a high degree of filtration but has a low nominal flow rate. For a small runoff event, water may be able to seep through lower bag region 1120 as quickly as runoff enters catch basin 9000 and/or lower bag region 1120 may provide sufficient volume to store water that begins to collect within bag filter 1100 when the flow rate of runoff entering bag filter 1100 exceeds the flow rate of water being filtered through lower bag region 1120. In such events, all of the water exiting bag filter 1100 passes through lower bag region 1120 and is highly filtered with, typically, all debris and most or all particulate matter retained within bag filter 1100. For example, some silts may pass through lower bag region 1120 with sands, gravels, and debris retained within bag filter 1100.

Closed end 1105 of bag filter 1100 touches or extends beneath the surface of the standing water within catch basin 9000. The water and silts seeping through lower bag region 1120 will tend flow down the outer surface of bag filter 1100 and mix with the water already present in catch basin 9000. Limited kinetic energy is associated with this process. The sediments 9040 already present at the bottom of catch basin 9000 are not likely to be disturbed. As the water level in catch basin 9000 outside of bag filter 1100 begins to rise above the invert of catch basin outlet 9020, water will begin to pass through lower tent region 1220 and the perforations in spacing member 1500 and flow out of catch basin 9000. Lower tent region 1220 is also made of material with a small apparent opening size that provides a high degree of filtration and has a low nominal flow rate. The material making up lower tent region 1220 can have the same or a different apparent opening size than the material making up lower bag region 1120. Tent filter 1200 helps retain particulate matter and debris within catch basin 9000 where, due to the low levels of kinetic energy in the system, the particulate matter and debris are likely to settle to sediments 9040 at the bottom of catch basin 9000. When inlet pipes 9025 are present, tent filter 1200 separates water entering catch basin 9000 from upstream portions of the drainage system from the inner portion 9005 of the cavity of catch basin 9000 where particulate matter has settled and/or is settling.

Figure 2B:
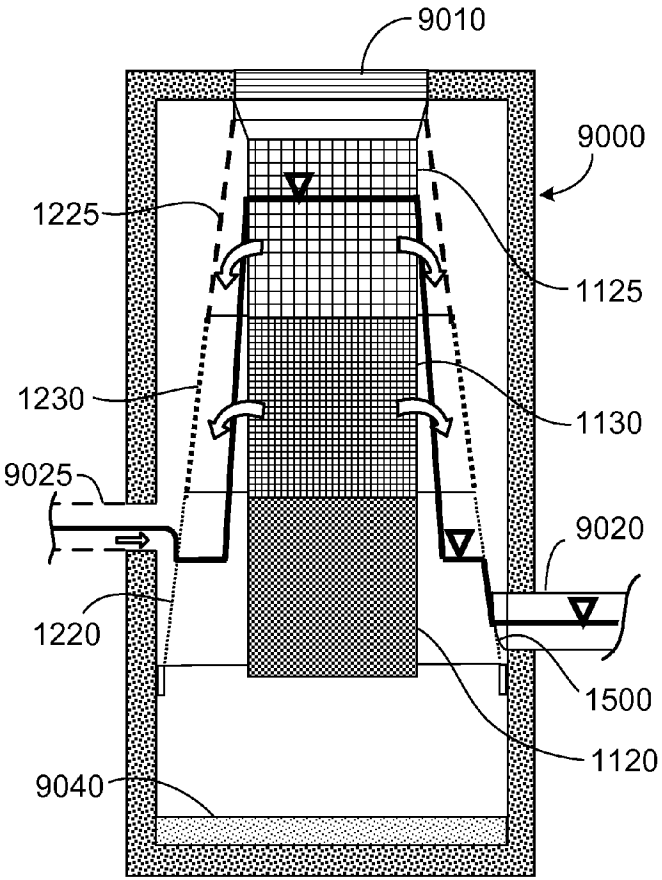
FIGS. 2A-2D are cross-sectional views of the two-filter system shown in FIGS. 1A-1D during a runoff event.
Figure 2A:
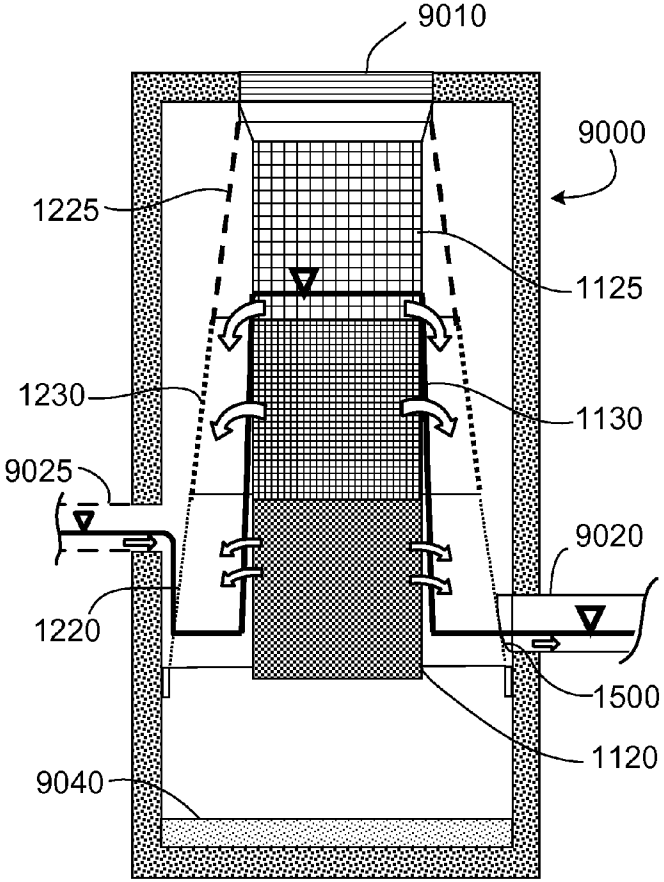

Referring to FIG. 2A, during some runoff events (e.g., during intense and/or prolonged storms), the flow rate of runoff entering bag filter 1100 exceeds the flow rate of water being filtered through lower bag region 1120 and the amount of runoff accumulating within bag filter 1100 exceeds the storage capacity of specific portions or all of bag filter 1100. As discussed with reference to small runoff events, the water level within bag filter 1100 begins to rise when the flow rate of runoff entering bag filter 1100 exceeds the flow rate of water being filtered through the bottom 1105 and sidewalls 1110 of bag filter 1100. Initially, only small amounts of highly filtered water seeps through lower bag region 1120. As the water level within bag filter 1100 rises into middle and upper bag regions 1125, 1130, water begins to pass through bag filter 1100 in these regions. The flow capacity of a given bag region is a function of factors including the nominal flow rate (gallons per minute per square foot) of the material and the flow area. As each bag region has larger apparent opening sizes and a higher nominal flow rate than the lower, adjacent bag region, each bag region has a greater flow capacity but provides less filtration than the lower, adjacent bag region. The flows of water through system 1000 are generally indicated by the black arrows on FIGS. 2A-2D with larger arrows schematically indicating higher flow rates and/or velocities. In this embodiment, each of the bag regions is approximately equal in size. However, in some embodiments, the sizes of individual bag regions vary (e.g., lower bag region 1120 may be larger than middle and upper bag regions 1125, 1130) as a means of adjusting the filtration and retention characteristics of a specific bag filter.

Referring to FIGS. 2A and 2B, water passing through bag filter 1100 is initially provided with secondary filtration by the lower tent region 1220 before flowing out of catch basin 9000 through catch basin outlet 9020. As water begins to pass through middle and upper bag regions 1125, 1130, the flow rate of water out of bag filter 1100 can be greater than the flow rate of water through lower tent region 1220. When this occurs, the water level between bag filter 1100 and tent filter 1200 begins to rise. As this occurs, water flowing out of catch basin 9000 has been provided with some degree of primary filtration by bag filter 1100 and a high degree of secondary filtration by lower tent region 1220. As the surface level of the water is rising, the distance between the more turbulent surface level and the volatile silt on the bottom of the catch basin increases and can provide an increasing buffer zone as flow through the overall system increases.

When inlet pipe(s) 9025 are present, tent filter 1200 separates water entering catch basin 9000 from upstream portions of the drainage system from the inner portion 9005 of the cavity of catch basin 9000 where particulate matter has settled and/or is settling. Water flowing into catch basin 9000 from inlet pipe(s) 9025 mixes with water already present in the outer portion 9007 of the cavity of catch basin 9000 (e.g., outside of tent filter 1200) and flows out of catch basin 900 through outlet pipe 9020. Water from upstream effectively bypasses treatment system 1000 but is separated from sediments 9040. The sediments 9040 already present at the bottom of catch basin 9000 are not likely to be disturbed by water from upstream portions of the drainage system. Referring to FIG. 2B, spacing member 1500 holds lower tent region 1220 away from catch basin outlet 9020. If lower tent region 1220 is pressed against the inner wall of catch basin 9000 covering catch basin outlet 9020, flow out of catch basin 9000 can be limited by the flow capacity of an area of lower tent region 1220 the size of catch basin outlet 9020. With lower tent region 1220 spaced apart from the inner wall of catch basin 9000, water can flow through various portions of tent filter 1200 and into the open top of spacing member 1500 as well as through portions of lower tent region 1220 in contact with the sidewalls of spacing member 1500. In other embodiments, tent filter 1200 can be mounted in catch basin 9000 with support member 1400 located in a position which holds tent filter 1200 taut to provide separation between lower tent region 1220 and walls of catch basin 9000 in the vicinity of catch basin outlet 9020.

Figure 2D:
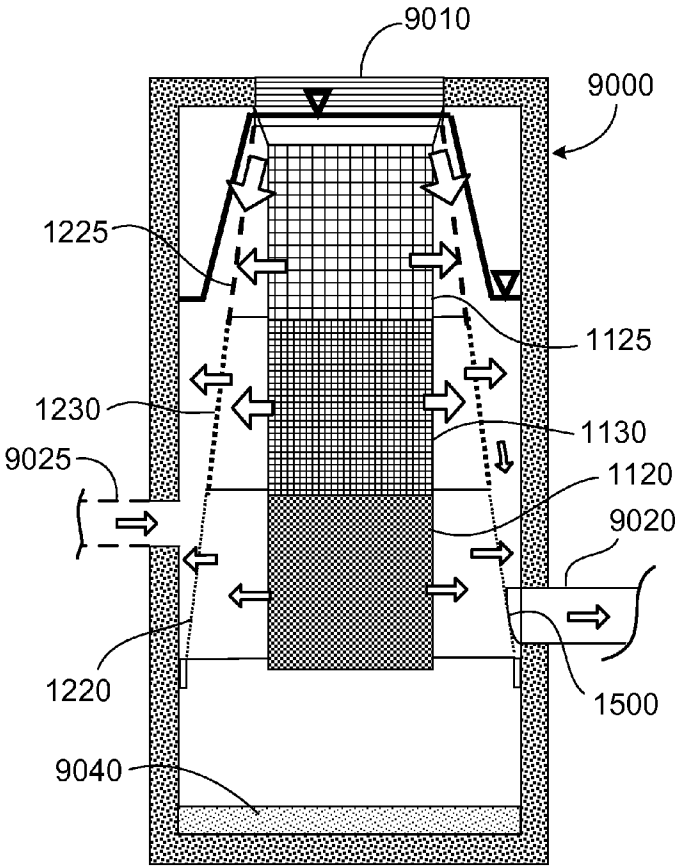
Figure 2C:
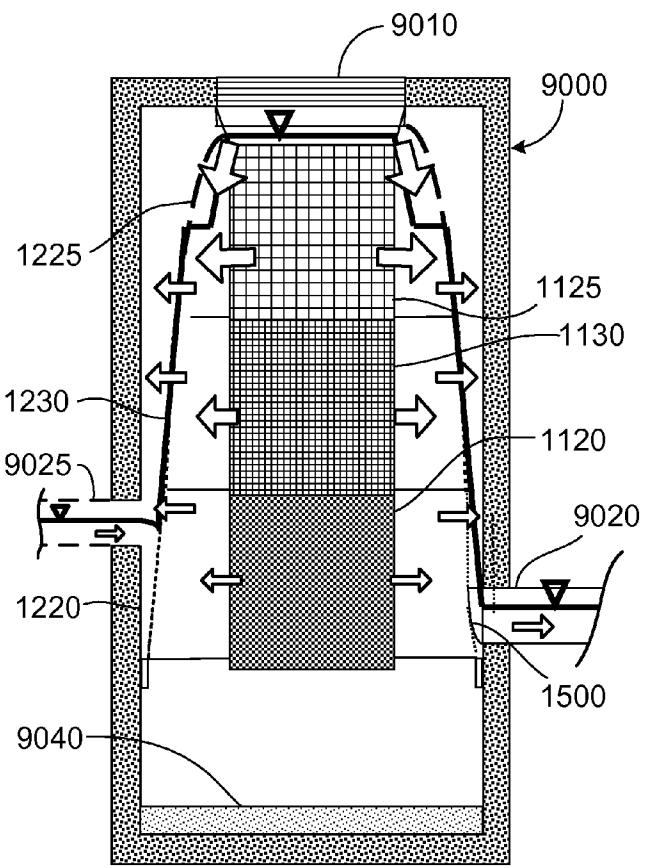

Referring to FIG. 2C, in some runoff events, the water level in bag filter 1100 rises to the point that some runoff begins to spill over the top of bag filter 1100 rather than passing through bag filter 1100. When this occurs, only a portion of the water between bag filter 1100 and tent filter 1200 has received primary filtration. As the water level between bag filter 1100 and tent filter 1200 rises, water begins to pass through middle and upper tent regions 1225, 1230. Thus, in this flow regime, all water flowing out of catch basin 9000 that entered through catch basin inlet portion 9010 has received at least some degree of treatment from tent filter 1200. In this embodiment, tent filter is made of a pleated material and expands to provide additional storage is the water level between bag filter 1100 and tent filter 1200 (e.g., particularly when the water level between bag filter 1100 and tent filter 1200 is significantly higher in the water level between tent filter 1200 and the walls of catch basin 9000). In some embodiments, tent filter 1200 is not made of pleated material.

Referring to FIG. 2D, in some extreme runoff events, the water level between bag filter 1100 and tent filter 1200 rises to the point that some runoff begins to spill over the top of tent filter 1200. When this occurs, some of the water flowing out of catch basin 9000 has passed through both bag filter 1100 and tent filter 1200, some of the water has passed through only tent filter 1200, and some of the water has not been treated by either bag filter 1100 or tent filter 1200.

As time passes, the amount of particulate matter and debris collected in bag filter 1100 and catch basin 9000 increases. Most large particulate matter and debris will remain in bag filter 1100, while smaller particulate matter and debris, for example sand and sediment, will collect both in bag filter 1100 and in catch basin 9000. Periodical removal of this particulate matter and debris from bag filter 1100 and catch basin 9000 will ensure that each operates effectively.

Figure 3A:
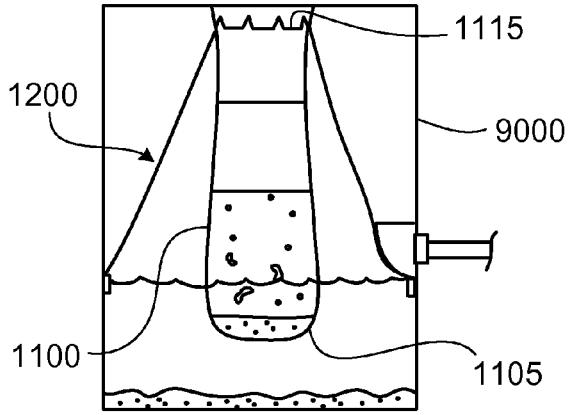
FIGS. 3A-3C are side views of a method of cleaning a two-filter system.
Figure 3C:
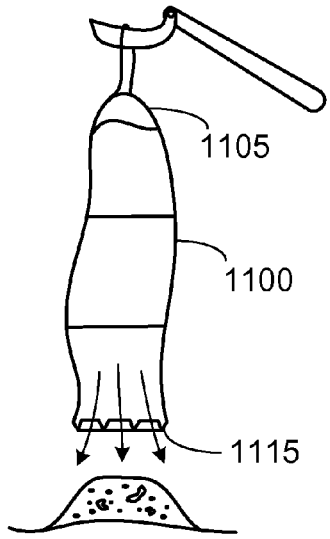
Figure 3B:
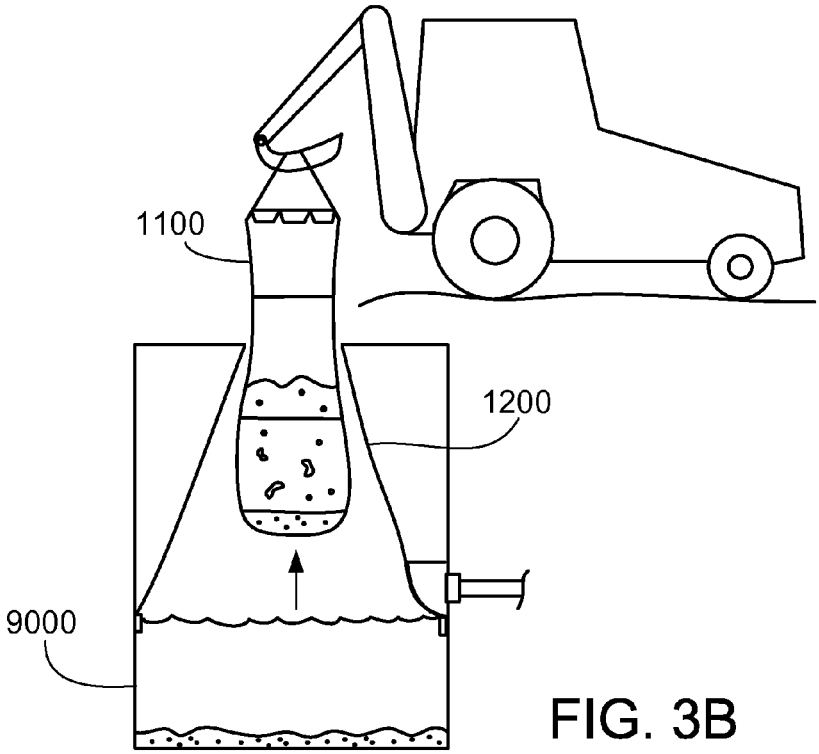

Referring to FIGS. 3A-3C, bag filter 1100 may be removed from catch basin 9000 uses various machines (e.g., machines common to construction sites and/or commonly owned by municipalities such as loaders, backhoes, bobcats, excavators, and hoists installed on municipal trucks or other vehicles). Removal of bag filter 1100 is accomplished by attaching inlet 1115 to a machine capable of lifting bag filter 1100 vertically. Alternatively, if inlet 1115 is attached to frame 1300, then frame 1300 may be attached to a machine capable of lifting bag filter 1100 vertically. Using the machine, bag filter 1100 can then be lifted vertically through the catch basin inlet 9010 and placed, for example, on the ground. Formed of flexible material, bag filter can be squeezed through catch basin inlet 9010 if bag filter 1100 has expanded somewhat due to the accumulation of particulate matter and debris. Inlet 1115 or frame 1300 is then detached from the machine. To empty the contents of bag filter 1100, closed end 1105 is attached to a machine capable of lifting bag filter 1100 with its contents. As closed end 1105 is lifted above inlet 1115, particulate matter and debris collected in the bag will exit bag filter 1100 through inlet 1115. This procedure may be used to empty the particulate matter and debris, for example, onto the ground, or into a truck or other vehicle that can transport the particulate matter and debris for offsite disposal.

With bag filter 1100 removed from catch basin 9000, particulate matter and debris collected in catch basin 9000 can be removed (e.g., using a vacuum truck to vacuum out the particulate matter and debris, or manual removal of the particulate matter and debris with a shovel or other suitable tool).

Once particulate matter and debris has been removed from either or both of bag filter 1100 and catch basin 9000, bag filter 1100 can be re-installed as described above. In this manner, bag filter 1100 may be re-used. In some instances, bag filter 1100 and/or tent filter 1200 can be rinsed (e.g., with freshwater) from within to remove attached particular matter and/or debris before bag filter 1100 is reinstalled in catch basin 9000. The gap between bag filter 1100 and tent filter 1200 can also allow tent filter 1200 to be rinsed from outside inward (i.e., towards the center of the catch basin.).

Tent filter 1200 can also be configured for ease of cleaning. For example, as discussed above, tent filter 1200 can be configured to provide a truncated conical surface between outer and inner portions 9005, 9007 of the cavity of catch basin 9000 such that the inner portion 9005 of the cavity of the catch basin 9000 is below as well as within the outer portion 9007 of catch basin 9000. Flow of runoff through tent filter 1200 can cause particulate matter to accumulate on what is, in effect, the underside of tent filter 1200. Thus, in the absence of internal water pressure, gravity will tend to pull accumulated particulate matter off tent filter 1200 into the bottom of the catch basin 9000 to settle. Spraying tent filter 1200 from the outer portion 9007 of the catch basin towards the inner portion 9005 of the cavity of the catch basin to backwash the tent filter is also aided by the effects of gravity.

In some cases, system 1000 includes bag filter 1100 and tent filter 1200 jointly installed in catch basin 9000. Bag filter 1100 may be installed by mounting open end 1115 to a region of catch basin inlet 9010, or by attaching open end 1115 to frame 1300 (e.g., using ropes or chains), and mounting frame 1300 to region of catch basin inlet 9010. When installed, open end 1115 of bag filter 1100 should be suspended beneath catch basin inlet 9010, such that closed end 1105 reaches or extends beneath the standing water level inside catch basin 9000. Tent filter 1200 may be installed by attaching first end portion 1205 to either catch basin inlet 9010 or frame 1300, and by attaching second end portion 1210 to an inner surface 9030 of catch basin 9000 separated from catch basin inlet 9010. Second end portion 1210 may be attached using a support member 1400 that presses all or part of second end portion 1210 against inner surface 9030. Alternatively, second end portion 1210 may be attached to inner surface 9030 using fasteners (e.g., staples, hooks, nails, or adhesives). Additionally, second end portion 1210 may be attached to support member 1400, which may in turn be attached to inner surface 9030.

In some systems, bag filter 1100 is used without tent filter 1200. In these embodiments, bag filter 1100 is generally as described above. However, once water, particulate matter, and debris enter catch basin 9000, there is no additional filter to help retain the particulate matter and debris in catch basin 9000. Similarly, in some systems, tent filter 1200 is used without bag filter 1100. In these embodiments, tent filter 1200 is generally as described above. However, the kinetic energy of water, particulate matter, and debris falling through catch basin inlet 9010 are not dissipated by bag filter 1100 and particulate matter and debris inside the catch basin may be re-suspended in the water. However, there is still the benefit of the rising water level increasing the distance between the more turbulent surface level and the volatile silt on the bottom of the catch basin increases.

Figure 4:
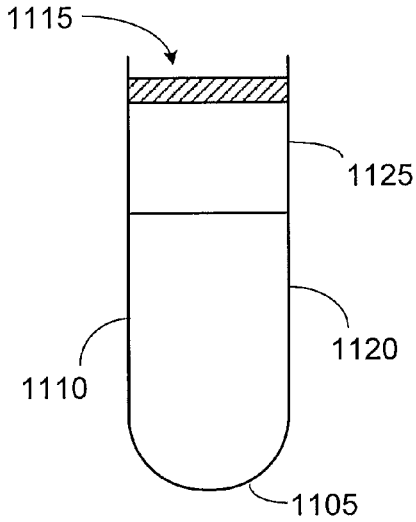
FIGS. 4 and 5 are side views of filter embodiments.
Figure 5:
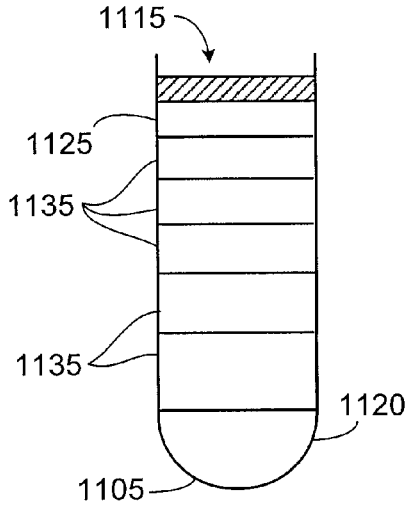

A number of embodiments of the invention have been described. Nevertheless, it will be understood that various modifications may be made without departing from the spirit and scope of the invention. For example, bag filter 1100 may include a handle attached to closed end 1105 to aid in removal of particulate matter and debris as explained above. In another example, referring to FIG. 4, some embodiments of bag filters 1100 have only first bag region 1120 and second bag region 1125. In another example, referring to FIG. 5, in some embodiments bag filter 1100 have first region 1120 having a first nominal flow rate, a second region 1125 having a second nominal flow rate, and a plurality of intermediate bag regions 1135 located between first bag region 1120 and second bag region 1125 and having a plurality of nominal flow rates. The nominal flow rate of each of intermediate bag regions 1135 is greater than the nominal flow rate of the adjacent bag region in the direction of first bag region 1120, and is less than the nominal flow rate of the adjacent bag region in the direction of second bag region 1125. Thus, the various nominal flow rates of the various bag regions are aligned such that the lowest nominal flow rate occurs nearest closed end 1105 and the greatest nominal flow rate occurs nearest open end 1115. Each of the first, second, and plurality of intermediate bag regions, individually or collectively, may be equal or different in size.

Accordingly, other embodiments are within the scope of the following claims.

What is claimed is:

1. A system configured to treat water passing through a catch basin, the system comprising:

a first filter comprising an open end, a sidewall portion, and a closed end opposite the open end, the open end of the first filter removably mounted below an inlet of the catch basin; and a second filter extending from a first end portion having a first perimeter to a second end portion having a second perimeter, the first end portion of the second filter removably mounted to define an opening below the inlet of the catch basin, and the second end portion of the second filter removably secured to an inner surface of the catch basin at a location spaced apart from the inlet of the catch basin, such that the second filter defines a surface separating an inner portion of a cavity of the catch basin from an outer portion of the cavity of the catch basin.

2. The system of claim 1, wherein the sidewall portion of the first filter comprises a support structure comprising a first fabric having a first apparent opening size, the support structure lined with a second fabric having a second apparent opening size that is relatively smaller than the first apparent opening size.

3. The system of claim 2, wherein the second fabric comprises woven material.

4. The system of claim 1, wherein the first filter has an outer perimeter substantially identical in shape and smaller in size to an inner perimeter of the inlet to the catch basin.

5. The system of claim 1, further comprising a support member attached to the second end portion of the second filter and removably secured to the inner surface of the catch basin.

6. A system configured to treat water passing through a catch basin, the system comprising:

a filter extending from a first end portion having a first perimeter defining an opening to a second end portion having a second perimeter, the first end portion attached to an inlet of a catch basin and the second end portion removably secured to an inner surface of the catch basin at a location spaced apart from the inlet of the catch basin, such that the filter defining a continuous surface separating an inner portion of a cavity of the catch basin from an outer portion of the cavity of the catch basin;

wherein the inner portion of the cavity of the catch basin is defined in part by the bottom of the catch basin.

7. The system of claim 6, further comprising a spacing member removably secured to an inner surface of the catch basin, the spacing member disposed between the filter and an outlet of the catch basin.

8. The system of claim 6, wherein the filter is removably mounted such that an outlet defined by the catch basin opens into the outer portion of the catch basin.

9. The system of claim 8, wherein the filter is removably mounted such that an inlet pipe opens into the outer portion of the catch basin.

10. The system of claim 6, wherein the filter comprises a first filter region having a first nominal flow rate and a second filter region having a second nominal flow rate relatively greater than the first nominal flow rate, the second filter region disposed between the first filter region and the first end portion.

11. The system of claim 10, wherein the filter further comprises a third filter region having a third nominal flow rate, the third filter region located between the first and second filter regions, the third nominal flow rate relatively greater than the first nominal flow rate and relatively less than the second nominal flow rate.

12. The system of claim 6, wherein the filter comprises a support structure and a separate porous liner material disposed inside the support structure.

13. The system of claim 6, wherein the filter comprises a pleated material.

14. The system of claim 6, further comprising a spacing member removably secured to an inner surface of the catch basin, the spacing member disposed between an outlet of the catch basin and the filter.

15. The system of claim 6, wherein the second end portion of the filter is removably secured to a sidewall of the catch basin.

16. The system of claim 15 wherein the second perimeter is larger than the first perimeter.

17. A method of treating runoff, comprising:

installing a filter in a catch basin in a position in which a first end portion of the filter is removably mounted to define an opening below the inlet of the catch basin, and a second end portion of the filter removably secured to an inner surface of the catch basin at a location spaced apart from the inlet of the catch basin, such that the second filter defines a surface separating an inner portion of a cavity of the catch basin from an outer portion of the cavity of the catch basin, wherein the inner portion of the cavity of the catch basin is defined in part by the bottom of the catch basin; and retaining some solid material within the inner portion of the catch basin as water passes through the filter into the outer portion of the cavity of the catch basin and flows out an outlet of the catch basin.

18. The method of claim 17, comprising routing flow from upstream portions of a drainage system through the outer portion of the cavity of the catch basin.

19. The method of claim 17, comprising discharging flow from upstream portions of the drainage system into the outer portion of the cavity of the catch basin.

* * * * *